US008056803B2

(12) United States Patent
Wen

(10) Patent No.: US 8,056,803 B2
(45) Date of Patent: Nov. 15, 2011

(54) TICKET PROCESSING SYSTEM FOR PARKING LOT

(75) Inventor: Yung Wen, Taipei (TW)

(73) Assignee: Yua-Yung Marketing (Taiwan) Co., Ltd., Taipei (TW)

( * ) Notice: Subject to any disclaimer, the term of this patent is extended or adjusted under 35 U.S.C. 154(b) by 489 days.

(21) Appl. No.: 12/391,275

(22) Filed: Feb. 24, 2009

(65) Prior Publication Data

US 2010/0213260 A1 Aug. 26, 2010

(51) Int. Cl.
*G07B 15/02* (2011.01)

(52) U.S. Cl. ..... 235/384; 235/381; 235/382

(58) Field of Classification Search ..... 235/375, 235/378, 381, 382, 383, 384, 475; 705/1.75, 705/13, 16, 65, 418
See application file for complete search history.

(56) References Cited

U.S. PATENT DOCUMENTS

| | | | | |
|---|---|---|---|---|
| 6,084,532 | A * | 7/2000 | Prieto et al. | 340/933 |
| 6,411,937 | B1 * | 6/2002 | Brusseaux | 705/21 |
| 2006/0129500 | A1 * | 6/2006 | Mandy et al. | 705/65 |
| 2006/0170566 | A1 * | 8/2006 | Slemmer et al. | 340/932.2 |
| 2006/0180647 | A1 * | 8/2006 | Hansen | 235/375 |
| 2007/0126603 | A1 * | 6/2007 | Driscoll et al. | 340/988 |

* cited by examiner

*Primary Examiner* — Daniel Hess
*Assistant Examiner* — Tabitha Chedekel
(74) *Attorney, Agent, or Firm* — Leong C. Lei

(57) ABSTRACT

The ticket processing system utilizes RFID technique to record and access data in the parking tickets. The ticket processing system mainly contains at least a ticket reader positioned at the entry of the parking lot. A first antenna in the ticket reader writes data into a ticket having RFID chip and a second antenna at a ticket retrieval opening of the ticket reader erases data from the ticket. The ticket processing system further contains a number of third antenna at the various parking spots which records a spot number into the ticket to facilitate the later locating the whereabouts of the parked vehicle.

10 Claims, 2 Drawing Sheets

TICKET PROCESSING SYSTEM FOR PARKING LOT

TECHNICAL FIELD OF THE INVENTION

The present invention generally relates to fee paying for vehicle parking lots, and more particularly to a ticket processing system that employs RFID technology.

DESCRIPTION OF THE PRIOR ART

The present invention is an enhancement to the Republic of China, Taiwan, Patent No. M306369, filed by the present inventor, in making the fee paying process of parking lots even more convenient and speedily.

SUMMARY OF THE INVENTION

An objective of the present invention is that the ticket processing system utilizes RFID technique to record and access data in the parking tickets. The ticket processing system mainly contains at least a ticket reader positioned at the entry of the parking lot. A first antenna in the ticket reader writes data into a ticket having RFID chip and a second antenna at a ticket retrieval opening of the ticket reader erases data from the ticket.

Another objective of the ticket processing system is to provide a number of third antennas at the various parking spots in the parking lot which records a spot number into the ticket to facilitate the later locating the whereabouts of the parked vehicle, and the fee paying process of the parking lot.

Yet another objective of the ticket processing system is to provide a front panel device of the ticket reader which is capable of presenting the ticket at an appropriate angle to the vehicle owner so that the ticket could be quickly identified and picked up. The front panel device contains a front panel having a ticket entry opening and a ticket retrieval opening. The ticket retrieval opening has a wider upper portion and a narrower lower portion, and the ticket retrieval opening is able to block a lower portion of a coin-type ticket so that the ticket will not fall out of the ticket retrieval opening. In addition, a ticket passage channel is provided behind the front panel, connecting the ticking entry and retrieval openings. A first antenna and a first electromagnetic valve are both positioned adjacent to the passage channel and the ticket entry opening. When a ticket is dropped through the ticket entry opening, the first electromagnetic valve has its door closed to seal the passage channel. After data is written into the ticket through the first antenna, the door of the first electromagnetic valve is opened and the ticket drops towards the ticket retrieval opening. A section of the inner wall of the passage channel is closed in on towards the ticket retrieval opening, thereby forming a bulge which is more protrusive than the sections above and beneath the bulge, respectively. As such, a ticket at the ticket retrieval opening would have its lower rim closer to the bulge and its upper rim exposed out of the ticket retrieval opening.

The ticket reader further has an orientating and retardant device in the passage channel above the ticket retrieval opening whose purpose is to ensure that a ticket drops with a specific side facing forward and at a speed not too fast to bounce out of the ticket retrieval opening. The ticket would finally fall on a door of a second electromagnetic valve so that the ticket could be conveniently accessed out of the ticket retrieval opening. If the ticket is not removed after a predetermined period of time or after an external signal is received confirming that the ticket is not retrieved, a second antenna adjacent to the ticket retrieval opening is used to erase the data recorded in the ticket's chip and, then, the door of the second electromagnetic valve is opened to recover the ticket.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

BRIEF DESCRIPTION OF TUE DRAWINGS

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides a ticket processing system for parking lots that utilizes the Radio Frequency Identification (RFID) technology. According to the present invention, the tickets issued to the parked vehicles' owners should contain a readable and writable RFID chip.

Then, the ticket processing system mainly contains a ticket reader having a ticket entry opening, a ticket retrieval opening, and a passage channel between the ticket entry and exit openings. In addition, a first antenna and a first electromagnetic valve are both positioned within substantial proximity to the passage channel and the ticket entry opening. Similarly, a second antenna and a second electromagnetic valve are both positioned within substantial proximity to the passage channel and the ticket retrieval opening. The basic operation flow of the ticket reader is as follows. Initially, the first electromagnetic valve has its door closed to seal the passage channel. A ticket to be issued to a vehicle owner is first dropped on the door of the first electromagnetic valve, and some data is written into the ticket via the first antenna. Then, the door of the first electromagnetic valve is opened, and the ticket drops through the passage channel to the ticket retrieval opening held by the door of the second electromagnetic valve to be picked up by the vehicle owner. If the ticket is not picked up after a period of time or after an external signal is received confirming that the ticket is not picked up, the data in the ticked is erased by the second antenna and the second electromagnetic valve opens its door to recover the ticket.

Figure 1:
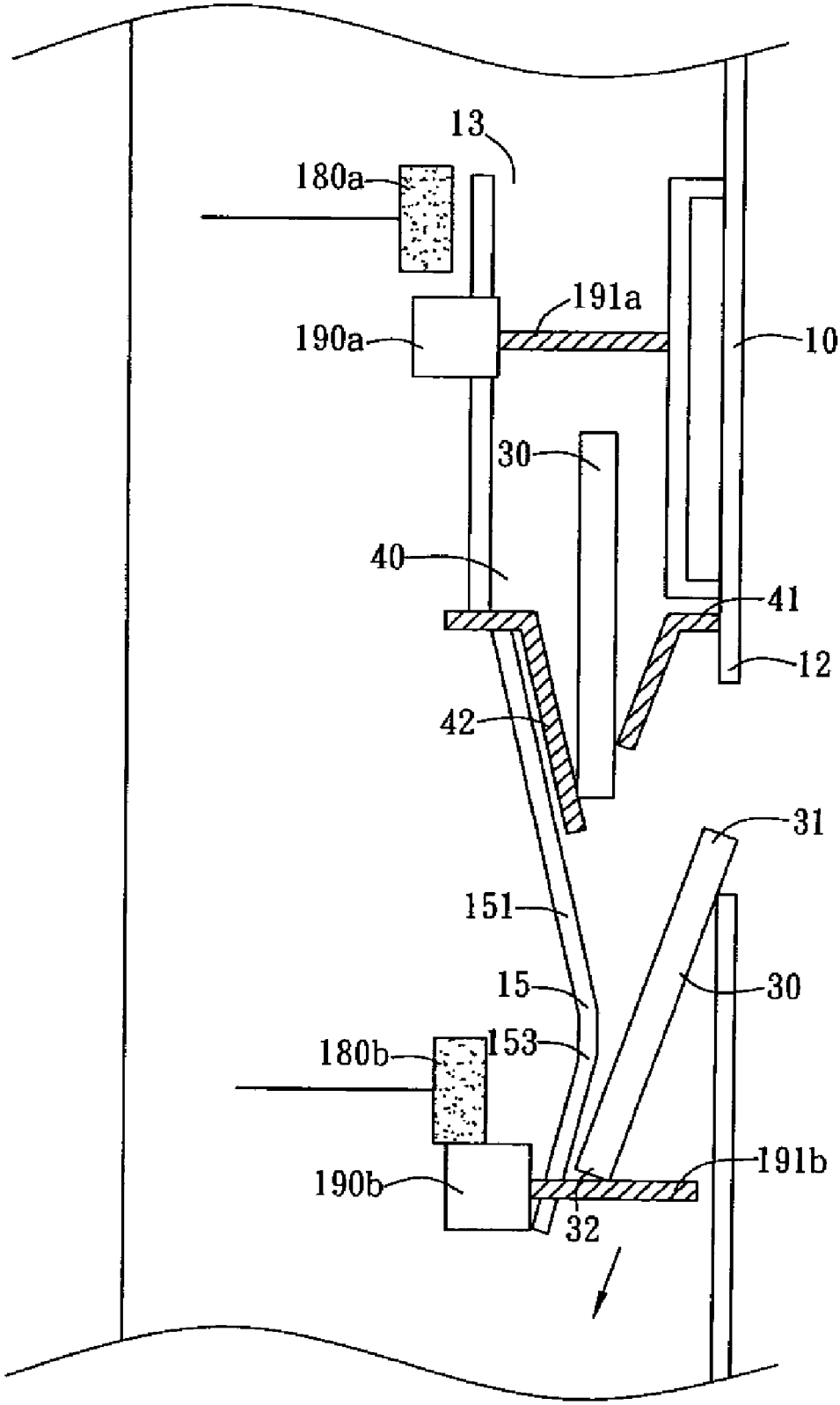
FIG. 1 is a schematic diagram showing a ticket reader according to an embodiment of the present invention.

FIG. 1 provides a ticket reader according to an embodiment of the present invention, which is also an improvement over that disclosed in the Republic of China, Taiwan, Patent No. M306369. As illustrated, the ticket reader has a front panel device capable of presenting the ticket at an appropriate angle to the vehicle owner so that the ticket could be quickly identified and picked up. The front panel device contains a front panel 10 having a ticket entry opening 16 and a ticket retrieval opening 12. The ticket retrieval opening 12 has a wider upper portion and a narrower lower portion, and the ticket retrieval opening 12 is able to block a lower portion of a coin-type ticket 30 so that the ticket 30 will not fall out of the ticket retrieval opening 12. In addition, a ticket passage channel 13 is provided behind the front panel 10, connecting the ticking entry and retrieval openings 16 and 12. A first antenna 180*a* and a first electromagnetic valve 190*a* are both positioned adjacent to the passage channel 13 and the ticket entry opening 16. When a ticket is dropped through the ticket entry opening 16, the first electromagnetic valve 190*a* has its door 191*a* closed to seal the passage channel 13. After data is written into the ticket 30 through the first antenna 180*a*, the door 191*a* of the first electromagnetic valve 190*a* is opened and the ticket 30 drops towards the ticket retrieval opening 12. A section of the inner wall of the passage channel 13 is closed in on towards the ticket retrieval opening 12, thereby forming a bulge 15 which is more protrusive than the sections 151 and 153 above and beneath the bulge 15, respectively. As such, a ticket 30 at the ticket retrieval opening 12 would have its lower rim 32 closer to the bulge 15 and its upper rim 31 exposed out of the ticket retrieval opening 12. Preferably, the front panel 10 could have side walls bended backwards and the bulge 15 is extended between the side walls. This slant-forward design could allow a user an enlarged view and easy access to the ticket.

The ticket reader further has an orientating and retardant device 40 in the passage channel 13 above the ticket retrieval opening 12 whose purpose is to ensure that a ticket 30 drops with a specific side facing forward and at a speed not too fast to bounce out of the ticket retrieval opening 12. The orientating and retardant device 40, preferably, contains a front retardant piece 41 and a back retardant piece 42, both made of a flexible material such as cloth, rubber, plastic, alloy capable of discharging electrostatics positioned in front of and behind the passage channel 13, respectively. A lateral slit is reserved between a bottom rim of the front and back retardant pieces 41 and 42 so as to allow the ticket 30 to pass through. Preferably, the front and back retardant pieces 41 and 42 are arranged to slant towards each other into a V-like shape so as to facilitate the ticket 30's dropping through the slit.

The ticket 30 would finally fall on a door 191*b* of a second electromagnetic valve 190*b* so that the ticket 30 could be conveniently accessed out of the ticket retrieval opening 12. If the ticket 30 is not removed after a predetermined period of time, a second antenna 180*a* adjacent to the ticket retrieval opening 12 is used to erase the data recorded in the ticket 30's chip and, then, the door 191*b* of the second electromagnetic valve 190*b* is opened to recover the ticket 30. At both the lateral ends of a bottom rim of the ticket retrieval opening 12, there are stopping plates extended inward into the ticket retrieval opening 12 so as to prevent the ticket 30 from falling out of the ticket retrieval opening 12.

The ticket 30 could be a card-type ticket or a coin-type ticket. The data written into the ticket 30 by the first antenna 180*a* may include license plate number, time entering the parking lot, etc. These pieces of information could be displayed by a display screen of the front panel device. The ticket reader could also contains a fee calculating device which could read the information stored in a ticket 30, calculate the parking fee accordingly, and put the fee amount on the display screen.

Figure 2:
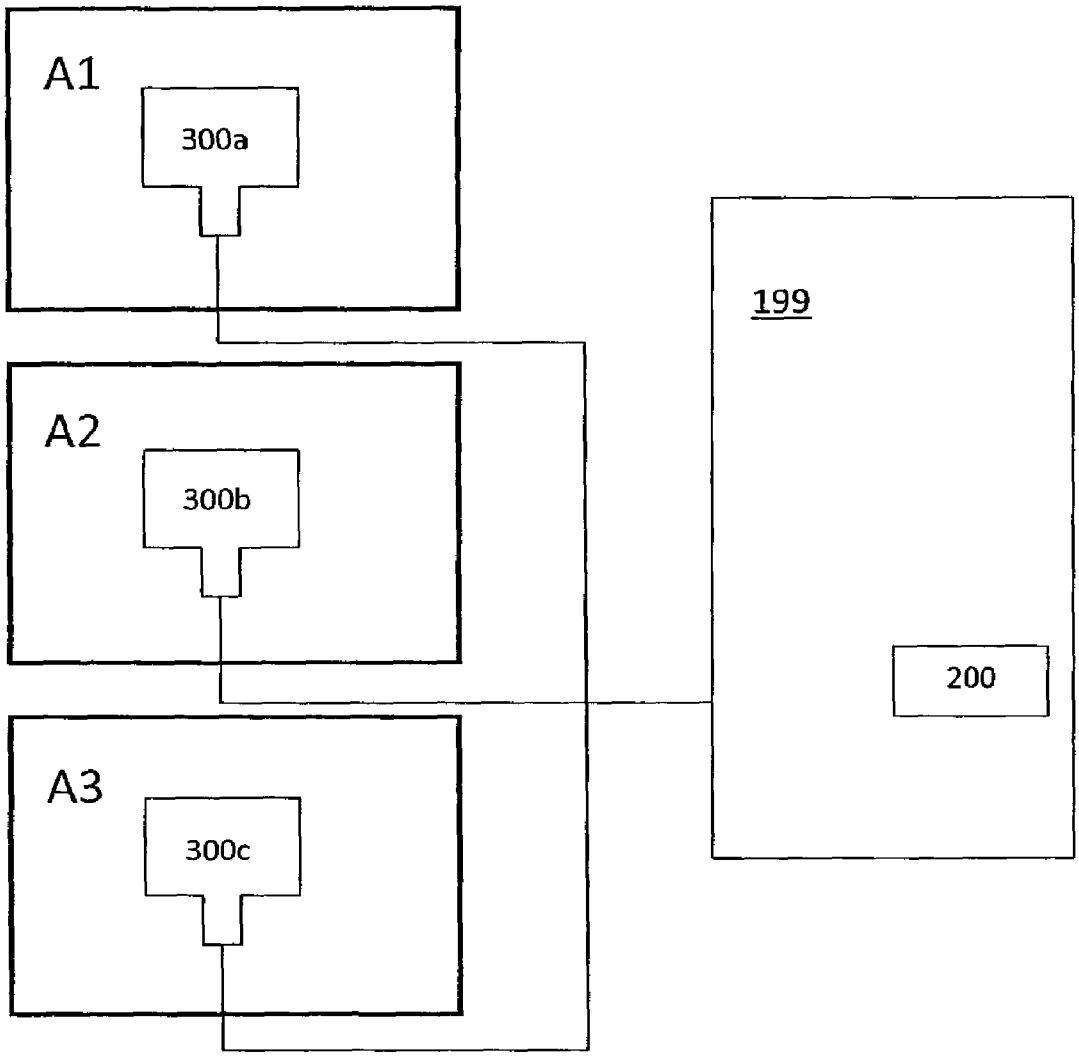
FIG. 2 is a schematic diagram showing a ticket processing system according to an embodiment of the present invention.

Please refer to FIG. 2. The ticket processing system 199 according to the present invention may further contains third antennas 300*a*, 300*b*, and 300*c*, positioned at various parking spots A1, A2, and A3, respectively, in the parking lot. Each of these parking spots is assigned a unique identification number and each spot is also equipped with a sensing device so that, when the sensing device senses a vehicle is parked in a specific spot, the sensing device instructs the appropriate third antenna, 300*a*, 300*b*, or 300*c*, to write the right identification number a ticket 30 of that vehicle. By having the parking spot number recorded in a ticket 30, the vehicle owner could use the ticket 30 and a ticket reader as described above to find out the specific spot where his or her vehicle is parked.

The ticket processing system 199 could further contain an error checking device 200 which evaluates the data to be written into a ticket 30 by the first, second, or third antenna 180*a*, 180*b*, and 300*a* (or 300*b*, 300*c*) to see if the data is correct. If the data is not correct, the error checking device 200 issues a signal to cancel the data writing action.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ticket processing system for a parking lot where a readable and writable RFID chip is installed in each parking ticket of said parking lot, comprising:

a ticket reading having a ticket entry opening, a ticket retrieval opening; and a passage channel connecting said ticket entry and retrieval openings;

a first antenna and a first electromagnetic valve positioned within substantial proximity to said passage channel and said ticket entry opening;

a second antenna and a second electromagnetic valve, both positioned within substantial proximity to said passage channel and said ticket retrieval opening;

wherein, initially, said first electromagnetic valve has a door closed to block a ticket from falling through said passage channel; data is written into said ticket via said first antenna; said door of said first electromagnetic valve is opened; said ticket drops through said passage channel onto a closed door of said second electromagnetic valve and is exposed out of said ticket retrieval opening; and, if said ticket is not picked up after a period of time or after an external signal is received confirming that said ticket is not picked up, data in said ticked is erased by said second antenna and said second electromagnetic valve opens its door to recover said ticket.

2. The ticket processing system according to claim 1, wherein said data written into said ticket by said first antenna is at least one of a license plate number and a time entering said parking lot; said ticket is one of a card-type ticket and a coin-type ticket; and said ticker reader comprises a display screen for showing said data.

3. The ticket processing system according to claim 2, further comprises a plurality of third antennas positioned at a plurality of parking spots of said parking lot, respectively; wherein each parking spot is assigned a unique identification number; and said identification number is written into a ticket by a third antenna in a vehicle parked in said third antenna's parking spot.

4. The ticket processing system according to claim 3, further comprising a plurality of sensing devices, each for a parking spot, wherein, when a sensing device senses a vehicle is parked in a specific parking spot, said sensing device instructs said parking spot's third antenna to write said parking spot's identification number into said ticket in said vehicle.

5. The ticket processing system according to claim 4, further comprising an error checking device which evaluates data to be written into a ticket by said first, second, or third antenna to see if said data is correct; and, if said data is not correct, said error checking device issues a signal to cancel the writing of said data into said ticket.

6. The ticket processing system according to claim 1, wherein said ticket reader further comprises a front panel device; said front panel device comprises a front panel forming said ticket entry opening and said ticket retrieval opening; said ticket retrieval opening has a wider upper portion and a narrower lower portion; and said ticket retrieval opening is able to block a lower portion of a ticket so that said ticket will not fall out of said ticket retrieval opening; said ticket passage channel is provided behind said front panel, connecting said ticking entry and retrieval openings; a section of the inner wall of said passage channel is closed in on towards said ticket retrieval opening, forming a bulge which is more protrusive than the sections above and beneath said bulge, respectively; as such, a ticket at said ticket retrieval opening would have its lower rim closer to said bulge and its upper rim exposed out of said ticket retrieval opening; said ticket reader further has an orientating and retardant device in said passage channel above said ticket retrieval opening whose purpose is to ensure that a ticket drops with a specific side facing forward and at a speed not too fast to bounce out of said ticket retrieval opening when said ticket falls on said door of said second electromagnetic valve.

7. The ticket processing system according to claim 6, wherein said front panel device further comprises a display screen for showing said data written into a ticket and read by one of said first, second, and third antennal; and said ticket reader further contains a fee calculating device which could read data stored in a ticket, calculate fee accordingly, and display fee on said display screen.

8. The ticket processing system according to claim 6, wherein said front panel could have side walls bended backwards; and said bulge is extended between said side walls.

9. The ticket processing system according to claim 6, wherein said orientating and retardant device comprises a front retardant piece and a back retardant piece, both made of a flexible material; said flexible material is one of cloth, rubber, plastic, alloy capable of discharging electrostatics positioned in front of and behind said passage channel 13, respectively; said front and back retardant pieces are arranged to slant towards each other into a V-like shape with a slit between the bottom rims so as to facilitate a ticket's dropping through said slit.

10. The ticket processing system according to claim 6, wherein, at both lateral ends of a bottom rim of said ticket retrieval opening, there are stopping plates extended inward into said ticket retrieval opening so as to prevent a ticket from falling out of said ticket retrieval opening.

* * * * *